US012291803B2

(12) United States Patent
Eschler

(10) Patent No.: US 12,291,803 B2
(45) Date of Patent: May 6, 2025

(54) LAMINAR VELOUR KNITWEAR

(71) Applicant: Schoeller Textil AG, Sevelen (CH)

(72) Inventor: Matthias Eschler, Balingen (DE)

(73) Assignee: Schoeller Textil AG, Sevelen (CH)

( * ) Notice: Subject to any disclaimer, the term of this patent is extended or adjusted under 35 U.S.C. 154(b) by 353 days.

(21) Appl. No.: 17/605,762

(22) PCT Filed: Mar. 17, 2020

(86) PCT No.: PCT/EP2020/057175

§ 371 (c)(1),
(2) Date: Oct. 22, 2021

(87) PCT Pub. No.: WO2020/216532

PCT Pub. Date: Oct. 29, 2020

(65) Prior Publication Data

US 2022/0213626 A1 Jul. 7, 2022

(30) Foreign Application Priority Data

Apr. 24, 2019 (CH) ..... 00552/19

(51) Int. Cl.
*D04B 21/04* (2006.01)
*D04B 21/20* (2006.01)

(52) U.S. Cl.
CPC ..... *D04B 21/04* (2013.01); *D04B 21/202* (2013.01); *D10B 2331/04* (2013.01); *D10B 2401/14* (2013.01); *D10B 2403/0121* (2013.01)

(58) Field of Classification Search
None
See application file for complete search history.

(56) References Cited

U.S. PATENT DOCUMENTS 4,297,858 A * 11/1981 Blasberg ..... D04B 21/04 66/194
4,315,419 A * 2/1982 Kernbichler ..... D04B 21/02 66/196
4,567,075 A * 1/1986 Krawczyk ..... D04B 21/02 28/162
4,624,116 A * 11/1986 Rogers ..... D04B 21/02 66/193
5,916,273 A * 6/1999 Hepfinger ..... D04B 21/04 66/194
6,063,473 A * 5/2000 Zafiroglu ..... B29C 70/24 428/95

(Continued)

FOREIGN PATENT DOCUMENTS

CN 107761242 A 3/2018
CN 108004667 A 5/2018

(Continued)

*Primary Examiner* — Megan E Lynch
(74) *Attorney, Agent, or Firm* — The Webb Law Firm

(57) ABSTRACT

A laminar velour knitted fabric is disclosed, which has an top side and a bottom side, the top side including a pile and the bottom side including a knitted fabric of at least one pile material and a base material. The at least one pile material in the knitted fabric is formed as at least one pile yarn and the base material in the knitted fabric is formed as at least one base yarn. Further, the pile includes the at least one pile material. The at least one pile material of the pile has individual fibrils with a fineness of at most 2 dtex per fibril.

11 Claims, 4 Drawing Sheets

(56) References Cited

U.S. PATENT DOCUMENTS

| | | | | |
|---|---|---|---|---|
| 6,196,032 | B1 * | 3/2001 | Rock | D04B 21/02 442/304 |
| 6,832,497 | B1 * | 12/2004 | Rock | D04B 35/34 66/195 |
| 2004/0060328 | A1 * | 4/2004 | Soeda | D04B 1/16 66/196 |
| 2005/0112975 | A1 * | 5/2005 | McMurray | D04B 21/18 442/306 |
| 2005/0160770 | A1 * | 7/2005 | Ikeda | D06Q 1/06 66/194 |
| 2007/0122585 | A1 * | 5/2007 | Fukuro | D04B 21/04 428/85 |
| 2007/0215231 | A1 * | 9/2007 | Hayashi | D03D 27/00 139/391 |
| 2012/0255643 | A1 * | 10/2012 | Duan | D03D 15/33 66/93 |
| 2019/0003087 | A1 * | 1/2019 | Matsumoto | D04B 1/04 |

FOREIGN PATENT DOCUMENTS

| | | | | |
|---|---|---|---|---|
| JP | 201169031 | A | | 4/2011 |
| KR | 20050022785 | A | * | 3/2005 |

* cited by examiner

LAMINAR VELOUR KNITWEAR

CROSS-REFERENCE TO RELATED APPLICATIONS

This application is the United States national phase of International Application No. PCT/EP2020/057175 filed Mar. 17, 2020, and claims priority to Swiss Patent Application No. 00552/19 filed Apr. 24, 2019, the disclosures of which are hereby incorporated by reference in their entireties.

BACKGROUND OF THE INVENTION

Field of the Invention

The invention relates to the technical field of suedes, in particular imitations of suedes, as well as to the production of laminar suedes.

Description of Related Art

Suede is used in large quantities in the clothing, furniture and construction industries, as well as in the automotive industry for the interior of motor vehicles. Despite its good durability, natural leather has some disadvantages. For example, the use of natural leather can be problematic for allergy sufferers. Furthermore, the production of natural leather represents a relatively large burden on the environment and is also increasingly viewed critically from an ethical point of view by consumers or even rejected outrig ht.

For these reasons, artificial imitations of suede based on microfiber textiles are increasingly being produced and used in a variety of ways. The advantage of such imitations is, among other things, that they can be made relatively hard-wearing, easy to clean, allergy-neutral and antistatic. However, to achieve such properties, a complex and costly manufacturing process is required, making many imitation suedes similar in price to natural leather.

One of the most widespread imitations of suede is known in Europe under the trade name Alcantara®, which is known as Ultrasuede® in the USA and Ecsaine® in Japan. This is a nonwoven microfiber fabric based on polyester and polyurethane, which was developed in Japan back in the early 1970s. In the production of Alcantara®, bicomponent staple fibers (polyester with polystyrene in the sheath) about 50 mm long are used as the starting material. The fiber bales are prepared in bale openers and fed to a nonwoven carding machine. These sort the fibers and place them on a conveyor belt. Subsequently, several layers are produced in the layer machine. A multi-stage mechanical needling process forms the bonded base nonwoven. In a chemical/thermal process, the polystyrene sheathing is now detached from the polyester filament. This process step in particular represents a major burden on the environment. Without the polystyrene sheath, the PES filament breaks down into thin individual fibrils that form a very dense and breathable surface. To fix the fibers in the textile, the nonwoven is impregnated with polyurethane in an immersion bath. In the next step, the nonwoven is now split into several layers (top, middle and bottom layer). The middle layer later represents the premium quality. Finally, the surface is napped, which provides the typical velvety soft or suede-like feel. Due to the complex manufacturing process, Alcantara® has no cost advantage over the production of natural leather. However, the industrial production of imitation suede has the advantage over natural leather that a uniform and reproducible quality can be achieved.

Imitation suedes are also known as "sea-island nonwovens". Here, a starting material consisting of a sea component and an island component is used. The imitation suede is obtained by selective dissolution of the sea component using alkaline solutions. The remaining island component finally forms the pile of the imitation suede.

SUMMARY OF THE INVENTION

Sea-island nonwovens are relatively costly to manufacture. Furthermore, the alkaline dissolution of the sea component considerably restricts the choice of material for the island component, since it must not be attacked, dissolved, modified and/or damaged by the alkaline solution. For example, certain polyesters are not suitable as island components because they hydrolyze relatively quickly under alkaline conditions.

It is therefore the general object of the invention to advance the prior art in the field of imitation suede leather and preferably to overcome the disadvantages of the prior art.

In some embodiments, a laminar velour knitted fabric for imitation suede is provided that can be produced in a time and cost efficient manner.

In some embodiments, a laminar velour knitted fabric for imitation suede is provided, which can be produced in a more environmentally friendly manner than has been possible using conventional processes.

In further embodiments, a laminar velour knitted fabric for imitation suede is provided that is soft to the touch, antistatic, durable, easy to clean, and/or allergy neutral.

In some embodiments, a laminar velour knitted fabric for imitation suede is provided that has high tensile strength and/or good fastness properties, particularly rubbing, dye, light, sweat and wash fastness. According to a first aspect of the invention, the general problem is solved by a laminar velour knitted fabric. The laminar velour knitted fabric comprises a top side and a bottom side, wherein the top side comprises a pile. The bottom side comprises a knitted fabric of at least one pile material and a base material. Alternatively, the bottom side may comprise a knitted fabric of exactly one pile material and a base material. The at least one pile material in the knitted fabric is formed as a pile yarn and the base material in the knitted fabric is formed as a base yarn. Further, the pile comprises the at least one pile material. However, the pile may also comprise the at least one pile material. The pile material of the pile further comprises individual fibrils having a fineness of at most 2 dtex per fibril. A fineness of no more than 2 dtex in the pile of the fibers provides a good surface finish to the velour knitted fabric. Typically, the proportion of individual fibrils relative to the total proportion of fibrils can be at least 50%, in particular at least 80%, preferably at least 90%.

The skilled person understands that the pile material can typically be arranged in the pile as well as in the knitted fabric of the laminar velour knitted fabric.

The knitted bottom side of the laminar velour knitted fabric ensures that the individual fibrils of the pile cannot be released from the velour knitted fabric and are firmly anchored in the velour knitted fabric by the stitches in the knitted fabric. Thus, an additional adhesive, such as an additional polyurethane coating on the bottom side, as is common in the prior art, can be dispensed with. Compared with known velour fabrics, in particular nonwoven-based velour fabrics, the knitted fabric is significantly more stable and tear-resistant as a result of the knitting process.

Compared to the Alcantara® imitation suede known in the prior art, the laminar velour knitted fabric according to the invention achieves either comparable or even better values (appearance, feel, residual shrinkage, heat shrinkage, fastness to sweat, fastness to friction and fastness to water, tensile strength, elongation at tear) with correspondingly the same weight, thickness and width. For example, the laminar velour knitted fabric according to DIN EN ISO 11640 or DIN EN ISO 105-X12 achieves a wet rub fastness of 4, while the comparative product only achieves a value of 3. In addition, the laminar velour knitted fabric according to the invention has a softer feel and increased air permeability compared to Alcantara®. In some embodiments, the base yarn and the pile yarn are preferably not identical. For example, the base yarn may have a different fineness than the pile yarn, or the base material may be different from the pile material.

In some embodiments, the at least one base yarn may comprise or consist of a flat yarn and/or the at least one pile yarn may comprise or consist of a textured yarn.

The skilled person understands that the term knitted fabric, as is common in this technical field, denotes a textile fabric in which a loop formed by means of a yarn is looped into another loop. The substantially regularly distributed loops thus formed may be formed using a single yarn or a plurality of yarns. Thus, a knitted fabric differs from a nonwoven fabric in which a loose collection of fibers is consolidated, in particular by heat, chemical or water needling, and thus just does not have regular interlacing like a knitted fabric.

The individual fibrils of the pile are separate fibrils. Thus, they are relatively movable independently of each other.

The fineness is specified in tex or decitex (dtex) according to the ISO 1144 and DIN 60905 standards. One dtex corresponds to 0.1 tex or 1 g per 10,000 meters.

In some embodiments, the at least one base yarn has a fineness of at most 5 dtex, in particular 3 dtex, preferably 2 to 2.5 dtex per fibril. The pile yarn may have a fineness of at most 1 dtex, preferably at most 0.3 dtex per individual fibril. A particularly good surface finish of the pile is achieved by means of a pile yarn with a fineness of maximum 0.3 dtex. By matching the fineness of the base yarn and the pile yarn, a particularly high-quality velour knitted fabric is achieved, which has a similarly velvety surface compared with the velour fabrics known in the prior art, in particular nonwoven-based velour fabrics. However, the production of the velour knitted fabric according to the invention is significantly more time and cost efficient.

In further embodiments, the knitted fabric has a combined lapping. The combined lapping comprises at least one lapping of the base yarn and one lapping of the pile yarn. By using a combined lapping, in particular different lappings, the stability, in particular in the longitudinal direction, of the laminar velour knitted fabric can be increased.

In some embodiments, the combined lapping has at least two lappings of base yarn and one lapping of pile yarn. Preferably, at least two lappings of the base yarn are different from each other, whereby a particularly dense knitted fabric can be achieved which anchors the individual fibrils of the pile particularly firmly. Thus, such a velour knitted fabric is particularly stable and durable.

In further embodiments, at least one lapping of the base yarn consists of a satin lapping and/or at least one lapping of the base yarn consists of a fringe lapping. Preferably, one lapping of the base yarn consists of a satin lapping and one lapping of the base yarn consists of a fringe lapping. In this case, the fringe lapping can block the lapping of the pile yarn, so that the pile yarn does not deviate during napping to form the pile and the pile can thus be produced particularly effectively.

In some embodiments, the lapping of the pile yarn consists of a satin lapping or a velvet lapping. In this case, the satin lapping results in a pile with shorter individual fibrils and the velvet lapping results in a pile with somewhat longer individual fibrils.

In further embodiments, the combined lapping consists of a satin-fringe-satin lapping or a satin-fringe-velvet lapping. Such a substantially layered construction with a fringe lapping provides a very high mesh strength and thus a velour knitted fabric with a higher resistance and tear strength than a non-woven based velour. Compared to Alcantara®, the laminar velour knitted fabric of the invention provides a significantly increased tear force (ISO 3341: 2000-05) in the transverse direction (1026 N compared to 360 N).

The various lappings are known to those skilled in the art. For example, a closed fringe lapping, as may be preferably used in the present invention, has a 1-0/0-1 lapping. A satin lapping, in the closed form, has a 1-0/3-4 lapping. A velvet lapping exhibits, in the closed form, a 1-0/4-5 lapping. Preferably, the velvet lapping and/or the satin lapping is used in the closed form.

The above-described embodiments with a combined lapping in combination with a base yarn with a fineness of maximum 3 dtex, preferably maximum 2 to 2.5 dtex per fibril, and a pile yarn with a fineness of maximum 1 dtex, preferably maximum 0.3 dtex, have proved to be particularly advantageous, as a velour knitted fabric with a very high stability can be achieved in this way. Thus, in the tear strength test according to DIN 13935-1, an actual value of 424 (textile breakage) is achieved lengthwise and an actual value of 519 (textile breakage and textile breakage at the seam) is achieved crosswise. In addition, outstanding results are obtained in the wear resistance test according to DIN EN ISO 12974-1. Thus, no breakage of the thread is observed even at over 50 000 tours.

In some embodiments, the knitted fabric has a stitch density of 150 to 800 meshes/cm$^2$, preferably 400 to 600 meshes/cm$^2$.

For example, the knitted fabric may have 5 to 20, preferably 10 to 15, more preferably 13 wales/cm and/or 30 to 40, preferably 30 to 35, more preferably 33 courses/cm.

In some embodiments, the pile may have between 250 000 and 350 000 individual fibrils per cm$^2$.

In further embodiments, the at least one base material and the at least one pile material consist of polyester. However, it is also possible to use polyamide or other synthetic fiber materials.

In some embodiments, the base yarn has 30 to 35 dtex and 15 fibrils and the pile yarn has 70 to 80 dtex and 300 fibrils. The use of such a yarn combination enables the provision of a very tight knit with a very high density of individual fibrils.

In further embodiments, the velour knitted fabric has a weight of 180 to 300 g/m$^2$, preferably 220 to 280 g/m$^2$.

According to a further aspect of the invention, the general object is achieved by a method for producing a laminar velour knitted fabric, in particular for producing a velour knitted fabric according to the invention. The method comprises the steps:

a) Providing at least one pile yarn made of a pile material and at least one base yarn made of a base material;
b) knitting the pile yarn and the base yarn with a knitting machine to form a raw knitted fabric of pile yarn and base yarn, wherein the raw knitted fabric has a top side and a bottom side and wherein the top side substantially comprises pile yarn;

c) Napping the top side of the raw knitted fabric, whereby the pile yarn at the top side of the knitted fabric is cut and a pile is formed;

d) Raising the pile.

The advantage of such a process over the state of the art is, among other things, that the total number of process steps is significantly reduced compared to the production of nonwoven-based velour fabrics. All common knitting machines can be used as knitting machines. However, warp knitting machines, in particular tricot warp knitting machines, are preferably used.

The skilled person understands that the top side, which essentially comprises pile yarn, can mainly consist of pile yarn. In particular, the surface of the top side of the raw knitted fabric may be formed of pile yarn, or consist of pile yarn, or at least comprise pile yarn.

Typically, raising the pile can be done by means of a second or more napping operations. However, the pile can also be erected at least partially already during step c). Thus, step d) can be performed together and/or after step c).

In some embodiments of the process according to the invention, the at least one base yarn has a fineness of at most 5 dtex, in particular 3 dtex, preferably from 2 to 2.5 dtex per fibril and/or the pile yarn has a fineness of at most 1 dtex, preferably at most 0.3 dtex per fibril.

In further embodiments, the knitting in step b) is performed with a combined lapping comprising at least two lappings of the base yarn and one lapping of the pile yarn.

In some embodiments, the raw knitted fabric is dyed by strand dyeing prior to raising the pile, and optionally subsequently dried.

In further embodiments, the knitting in step b) is performed with a knitting machine having a set fineness of E20 to E32, i.e., 20 to 32 needles per inch (8 to 12.6 needles per centimeter). Preferably, a fineness of E28 is set. Such a tight knitting has been found to be particularly advantageous for the surface finish and stability of the pile.

In other embodiments, the knitting in step b) is carried out with a combined lapping, wherein the lapping(s) of the base yarn is superimposed by the lapping of the pile yarn. Thus, it can be ensured that the surface of the top side of the raw knitted fabric consists essentially of pile yarn, whereby during subsequent napping only the pile yarn is cut through and the formed pile thus consists essentially of pile material. In general, the pile typically consists of the pile material, which may optionally be additionally dyed with dyes.

In further embodiments, the combined lapping has one lapping of the pile yarn and at least two lappings of the base yarn.

In some embodiments, at least one lapping of the base yarn consists of a satin lapping and/or at least one lapping of the base yarn consists of a fringe lapping and/or the lapping of the pile yarn consists of a satin lapping or velvet lapping.

In further embodiments, the combined lapping consists of a satin-fringe-satin lapping or a satin-fringe-velvet lapping. In the case of the satin-fringe-satin lapping, the knitting is performed by means of a first lapping bar with a 1-0/3-4 lapping of the base material, a second lapping bar with a 0-1/1-0 lapping of the base material, and a third lapping bar with a 3-4/1-0 lapping of the pile material. In the case of the satin fringe velvet lapping, the first and second lapping bars are identical to the satin fringe satin lapping, but the third lapping bar knits with a 4-5/1-0 lapping of the pile material.

Another aspect of the invention relates to the use of a laminar velour knitted fabric according to any of the embodiments described herein for the manufacture of imitation leather.

DETAILED DESCRIPTION

Figure 1A:
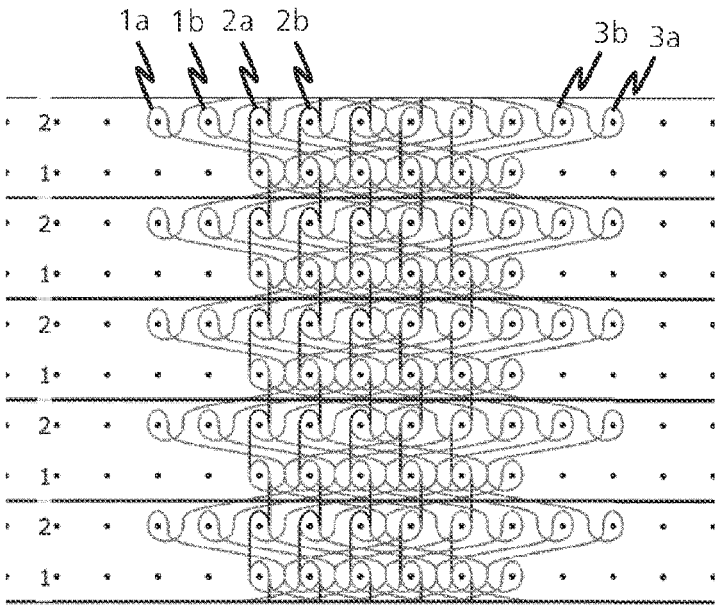
FIG. 1*a* shows a combined lapping of a laminar velour knitted fabric according to one embodiment of the invention.

FIG. 1*a* shows a combined lapping of a laminar velour knitted fabric according to the invention with two lappings of the base yarn 1*a*, 1*b* and 2*a*, 2*b* as well as one lapping of the pile yarn 3*a*, 3*b*. For each single lapping, 5 individual yarns are shown. The combined lapping consists of a satin-fringe-satin lapping. The first lapping bar knits a closed satin lapping (see 1*a*, 1*b*), the second lapping bar knits an open fringe lapping (see 2*a*, 2*b*) and the third lapping bar knits a closed satin lapping (see 3*a*, 3*b*). The open fringe lapping of the base yarn blocks the satin lapping of the pile yarn, which means that the pile yarn cannot escape during subsequent raising and thus an optimum surface finish of the pile can be provided with high efficiency.

Figure 1B:
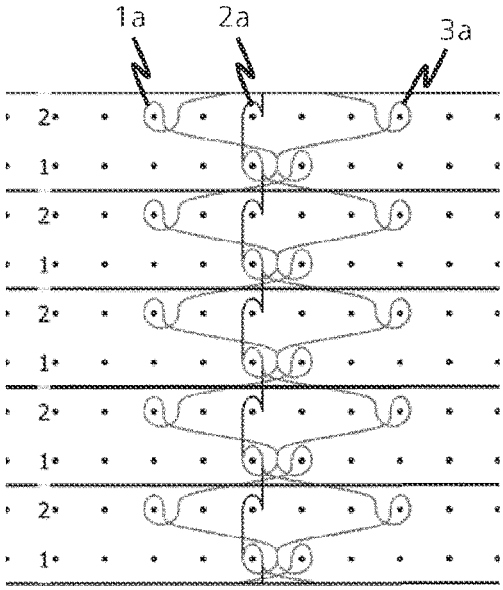
FIG. 1*b* shows the combined lapping of FIG. 1*a* as a single lapping.

In FIG. 1*b*, the combined lapping from FIG. 1*a* is shown, but only one single yarn is shown per lapping for a better overview.

Figure 2A:
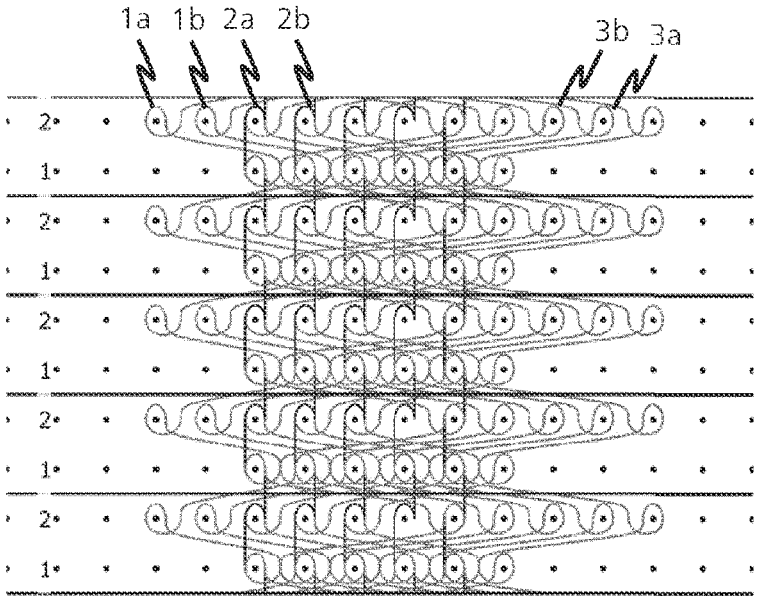
FIG. 2*a* shows a combined lapping of a laminar velour knitted fabric according to the invention in accordance with a further embodiment of the invention.

FIG. 2*a* shows a combined lapping of a laminar velour knitted fabric according to the invention with two lappings of the base yarn 1*a*, 1*b*, and 2*a*, 2*b*. In addition, the combined lapping comprises a further lapping of the pile yarn 3*a*, 3*b*. For each single lapping, 5 single yarns are shown. In contrast to the combined lapping shown in FIGS. 1*a* and 1*b*, the combined lapping consists of a satin-fringe-velvet lapping. By comparison with the combined lapping in FIGS. 1*a* and 1*b*, it is clear that after the raw knitted fabric has been napped, i.e. after the velvet lapping of the pile yarn has been cut, a pile with longer individual fibrils is produced than in a satin-fringe-satin lapping.

Figure 2B:
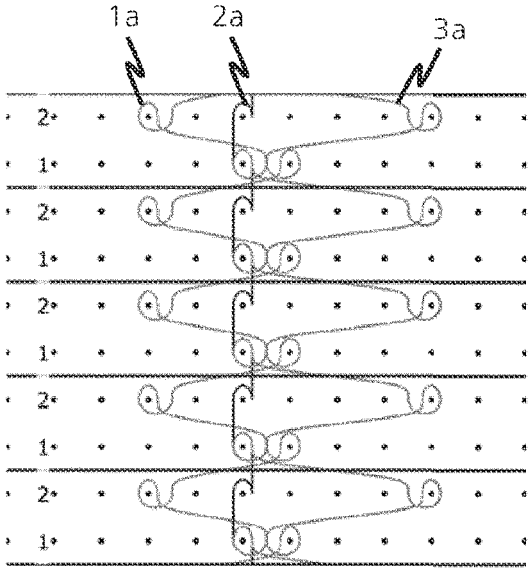
FIG. 2*b* shows the combined lapping of FIG. 2*a* as a single lapping.

FIG. 2*b* shows the combined lapping of FIG. 2*a*, but only one single yarn 1*a*, 2*a* and 3*a* is shown per lapping.

Figure 3:
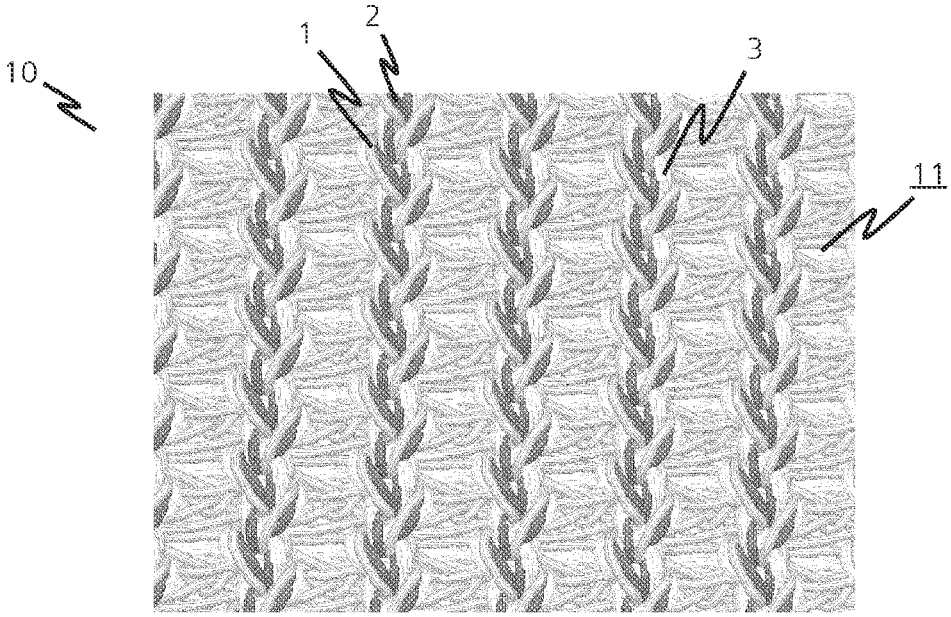
FIG. 3 shows a top view of the bottom side of a laminar velour knitted fabric according to a further embodiment of the invention.

FIG. 3 shows a top view of the bottom side 11 of a velour knitted fabric 10 according to the invention. The bottom side 11 comprises a knitted fabric of a pile material, which is formed as a pile yarn 3, and of a base material, which is formed as a first base yarn 1 and a second base yarn 2. Due to the very tight knitting, the pile yarn 3 is firmly anchored in the knitted fabric so that the individual fibrils of the pile are firmly anchored in the knitted fabric on the averted top side of the velour knitted fabric and do not disengage from the velour knitted fabric even without additional adhesive. For example, a polyester yarn dtex 33F15 can be used as the base yarn and a polyester yarn dtex 78F300 as the pile yarn.

Figure 4:
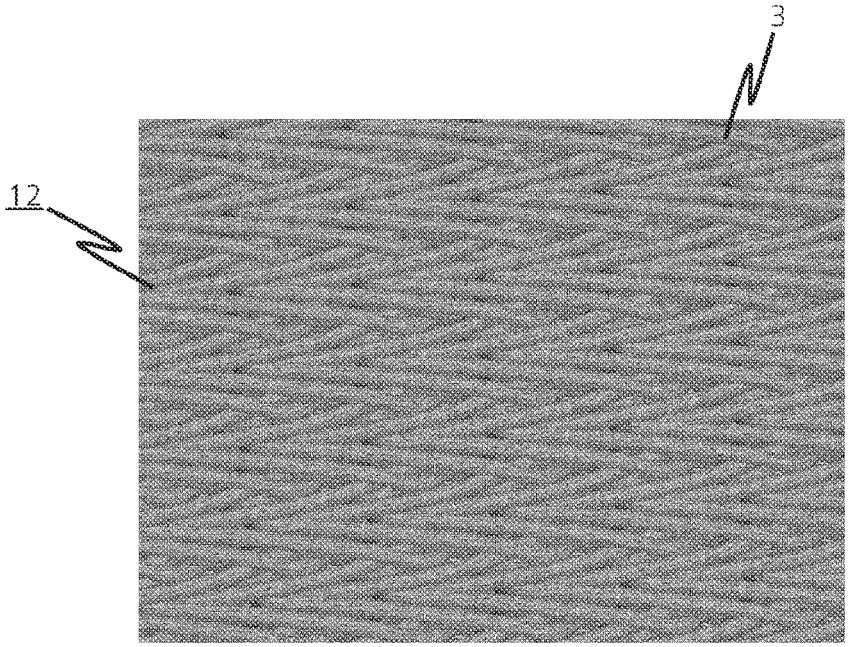
FIG. 4 shows a top view of a raw knitted fabric for the production of a velour knitted fabric according to the invention.
Figure 5:
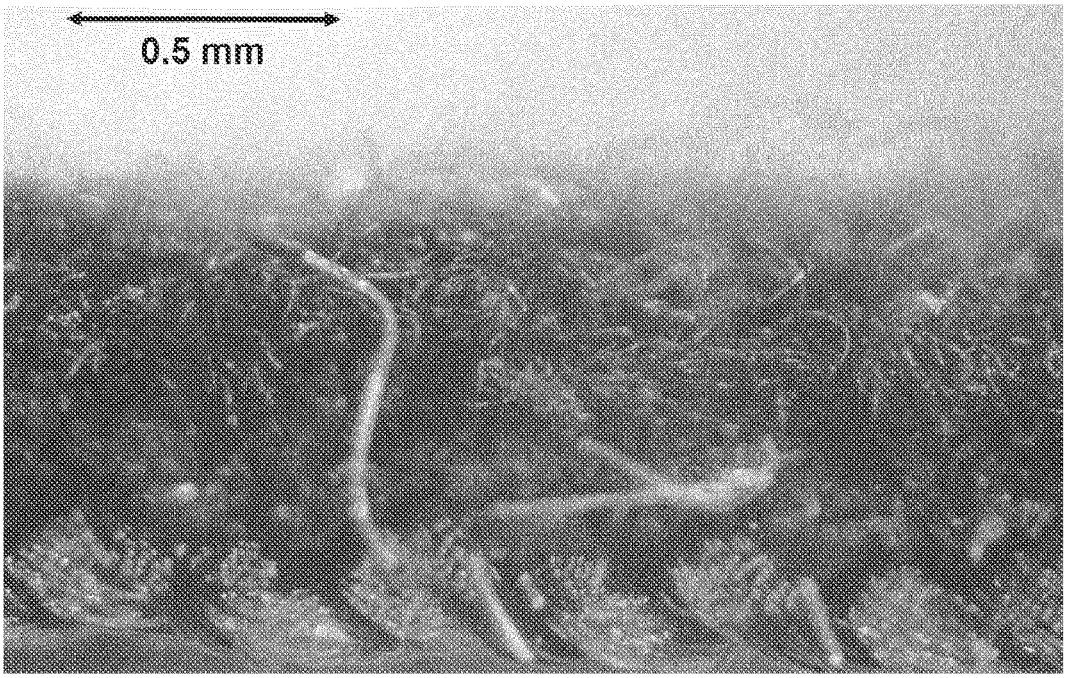
FIG. 5 shows a photograph of a cross-section of a laminar velour knitted fabric according to one embodiment of the invention.
Figure 6:
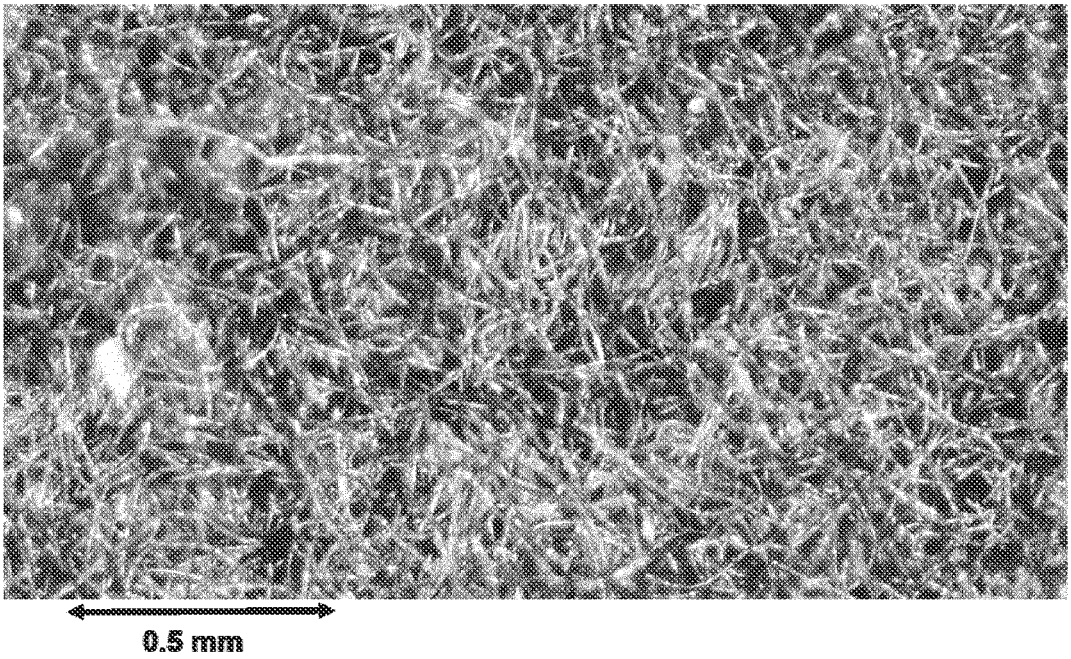
FIG. 6 shows a photograph of the pile of a laminar velour knitted fabric according to one embodiment of the invention.

FIG. 4 shows the top side 12 of a raw knitted fabric according to an embodiment of the invention. The surface of the top side 12 consists essentially of pile yarn 3, or is formed from it. Since the raw knitted fabric has not yet been napped and thus the pile yarn on the top side has not yet been cut, the pile has also not yet been formed.

The following table shows some relevant comparative values between the Alcantara® imitation suede known in the prior art and a laminar velour knitted fabric according to the present invention:

| Comparative value | Alcantara ® | Velour knitted fabric according to the invention | Norm |
|---|---|---|---|
| Residual shrinkage 40° C. Length [%] | −2.0 | −3 | DIN EN ISO 6330 |
| Residual shrinkage 40° C. Width [%] | −2.5 | −1 | DIN EN ISO 6330 |
| Heat shrinkage length [%] | −2.0 | −6.0 | DIN EN ISO 6330 |
| Heat shrinkage width [%] | −2.0 | −2.5 | DIN EN ISO 6330 |
| Washing 40° C. | 4-5 | 4-5 | DIN EN ISO 105 C10 |
| Sweat fastness alkaline | 4-5 | 4.5 | DIN EN ISO 105 E04 |
| Sweat fastness sour | 4-5 | 4-5 | DIN EN ISO 105 E04 |
| Rubbing fastness dry | 4-5 | 4-5 | DIN EN ISO 105 X12 |
| Rubbing fastness wet | 3 | 4 | DIN EN ISO 105 X12 |
| Water hard fastness | 4 | 4-5 | DIN EN ISO 105 E01 |
| Pilling | 4-5 | 4-5 | DIN EN ISO 12945 |
| Scrub test 50 000 tours | Slightly scuffed surface, no hole formation | No thread breakage, slight pile loss | DIN EN ISO 12974-1 |
| Tearing force length [N] | 222 | 204 | ISO 3341:2000-05 |
| Tearing force width [N] | 360 | 1026 | ISO 3341:2000-05 |
| Elongation at break length [%] | 89.8 | 80.5 | ISO 3341:2000-05 |
| Elongation at break width [%] | 57.1 | 67.9 | ISO 3341:2000-05 |
| Force 10% length [N] | 18.6 | 65.7 | DIN 53835-14:1992-11 |
| Force 10% width [N] | 116.0 | 89.2 | DIN 53835-14:1992-11 |
| Continued tear force length [N] | 17.5 | 23.0 | DIN EN ISO 13937 |
| Continued tear force width [N] | 13.0 | 11.9 | DIN EN ISO 13937 |

The invention claimed is:

1. An imitation leather comprising a laminar velour knitted fabric, the laminar velour knitted fabric comprising: a top side and a bottom side, wherein the top side comprises a pile and the bottom side comprises a knitted fabric of at least one pile material consisting only of polyester and at least one base material consisting only of polyester, wherein the at least one pile material of the knitted fabric is formed of at least one pile yarn and the base material in the knitted fabric is formed of at least one base yarn, wherein the pile comprises the at least one pile material, wherein the at least one pile material of the pile comprises individual fibrils with a fineness of at most 2 dtex per fibril, wherein the bottom side of the knitted fabric is free of an adhesive and the knitted fabric has a stitch density of 400 to 800 mesh/cm$^2$, and wherein the laminar velour knitted fabric does not contain an alkaline dissolution component.

2. The imitation leather according to claim 1, wherein the at least one base yarn has a fineness of at most 5 dtex per fibril, and/or the pile yarn has a fineness of at most 1 dtex per fibril.

3. The imitation leather according to claim 1, wherein the velour knitted fabric comprises a combined lapping, and wherein the combined lapping comprises at least one lapping of the base yarn and at least one lapping of the pile yarn.

4. The imitation leather according to claim 3, wherein the combined lapping comprises at least two lappings of the base yarn and at least one lapping of the pile yarn.

5. The imitation leather according to claim 3, wherein the at least one lapping of the base yarn comprises or consists of a satin lapping and/or a fringe lapping.

6. The imitation leather according to claim 3, wherein the at least one lapping of the pile yarn comprises or consists of a satin lapping and a velvet lapping.

7. The imitation leather according to claim 6, wherein the combined lapping comprises or consists of a satin lapping—fringe lapping—satin lapping or a satin lapping—fringe lapping—velvet lapping, wherein the satin lapping, in the closed form, has a 1-0/3-4 lapping, the fringe lapping, in the closed form, has a 1-0/0-1 lapping, and the velvet lapping, in the closed form, has a 1-0/4-5 lapping.

8. The imitation leather according to claim 1, wherein the velour knitted fabric has a stitch density of 400 to 600 meshes/cm$^2$.

9. The imitation leather according to claim 1, wherein the base yarn comprises 33 dtex and 15 fibrils and wherein the pile yarn comprises 78 dtex and 300 fibrils.

10. The imitation leather according to claim 1, wherein the velour knitted fabric has a weight of 180 to 300 g/m$^2$.

11. The imitation leather according to claim 1, wherein the at least one pile yarn has a fineness of at most 0.3 dtex per fibril.

* * * * *